US009120335B2

(12) United States Patent
Kakinuma et al.

(10) Patent No.: US 9,120,335 B2
(45) Date of Patent: Sep. 1, 2015

(54) PATTERN PRINTING APPARATUS, PATTERN PRINTING METHOD, AND TEST APPARATUS

(71) Applicant: ADVANTEST CORPORATION, Tokyo (JP)

(72) Inventors: Bunichi Kakinuma, Miyagi (JP); Takeshi Tanaka, Miyagi (JP); Toshiaki Hayakawa, Miyagi (JP); Jun Akedo, Ibaraki (JP); Akito Endo, Ibaraki (JP); Hiroki Tsuda, Ibaraki (JP)

(73) Assignee: ADVANTEST CORPORATION, Tokyo (JP)

( * ) Notice: Subject to any disclaimer, the term of this patent is extended or adjusted under 35 U.S.C. 154(b) by 0 days.

(21) Appl. No.: 13/957,438

(22) Filed: Aug. 2, 2013

(65) Prior Publication Data

US 2014/0063111 A1 Mar. 6, 2014

(30) Foreign Application Priority Data

Aug. 30, 2012 (JP) ..... 2012-190361

(51) Int. Cl.

| | |
|---|---|
| ***B41J 2/01*** | (2006.01) |
| ***B41J 11/00*** | (2006.01) |
| ***B41J 3/28*** | (2006.01) |
| ***B41J 3/407*** | (2006.01) |

(52) U.S. Cl.

CPC *B41J 11/002* (2013.01); *B41J 3/28* (2013.01); *B41J 3/407* (2013.01); *B41J 2202/04* (2013.01)

(58) Field of Classification Search

CPC ..... H05K 3/1208; B41J 11/002

See application file for complete search history.

(56) References Cited

U.S. PATENT DOCUMENTS

| | | | | |
|---|---|---|---|---|
| 6,599,582 | B2 * | 7/2003 | Kiguchi et al. | 427/466 |
| 2004/0082195 | A1 | 4/2004 | Yudasaka et al. | |
| 2005/0122351 | A1 * | 6/2005 | Yamazaki et al. | 347/5 |
| 2006/0203065 | A1 * | 9/2006 | Iwata et al. | 347/102 |
| 2010/0302319 | A1 * | 12/2010 | Akedo et al. | 347/54 |

FOREIGN PATENT DOCUMENTS

| | | | |
|---|---|---|---|
| JP | 2004200244 | A | 7/2004 |
| KR | 1020040047919 | A | 6/2004 |
| KR | 100989673 | B1 | 10/2010 |

(Continued)

OTHER PUBLICATIONS

Notice of Office Action for Korean Patent Application No. 10-2013-0085505, issued by the Korean Intellectual Property Office on Aug. 12, 2014.

(Continued)

*Primary Examiner* — Shelby Fidler

(57) ABSTRACT

A pattern printing apparatus comprising an ink output section including a nozzle that drops ink and a heating section that heats a preheating target region; a driving section that moves the substrate relative to the ink output section; and a control section that controls the driving section. The control section causes the substrate to move relative to the ink output section such that the preheating target region is positioned in a progression path of the drawing target region and causes a pattern formed by the ink to be drawn, and when switching an extension direction of the pattern being drawn, the control section causes the preheating target region to move to an end portion of the pattern drawn before the switching and causing the preheating target region to be heated.

8 Claims, 6 Drawing Sheets

(56) References Cited

FOREIGN PATENT DOCUMENTS

| | | | |
|---|---|---|---|
| WO | 2009/072603 | A1 | 6/2009 |
| WO | 2010/109739 | A1 | 9/2010 |
| WO | 2010/109740 | A1 | 9/2010 |

OTHER PUBLICATIONS

Notice of Office Action for Korean Patent Application No. 10-2013-0085505, issued by the Korean Intellectual Property Office on Apr. 30, 2015.

* cited by examiner

700

PATTERN PRINTING APPARATUS, PATTERN PRINTING METHOD, AND TEST APPARATUS

BACKGROUND

1. TECHNICAL FIELD

The present invention relates to a pattern printing apparatus, a pattern printing method, and a test apparatus.

2. Related Art

A conventional pattern drawing apparatus using an inkjet technique is known that applies ink including a conductive substance to a substrate and draws a pattern on the substrate, such as shown in Patent Document 1, for example. Furthermore, a test apparatus for testing a device under test is known, which tests a test package formed by mounting a device under test on a substrate having a wiring pattern drawn thereon, such as shown in Patent Documents 2 and 3, for example.

Patent Document 1: International Publication No. 2009/072603

Patent Document 2: International Publication No. 2010/109739

Patent Document 3: International Publication No. 2010/109740

It is sometimes preferable that the wiring pattern drawn on the substrate on which the device under test is mounted have a wire width and wire pitch no greater than tens of micrometers and include wires that can bend in a complicated manner. However, it is difficult to form such a wiring pattern using the inkjet-type pattern drawing apparatus.

SUMMARY

Therefore, it is an object of an aspect of the innovations herein to provide a pattern printing apparatus, a pattern printing method, and a test apparatus, which are capable of overcoming the above drawbacks accompanying the related art. The above and other objects can be achieved by combinations described in the claims. According to a first aspect of the present invention, provided is a pattern printing apparatus comprising an ink output section including a nozzle that drops ink onto a drawing target region of a substrate and a heating section that heats a preheating target region positioned within a progression path of the nozzle relative to the substrate; a driving section that moves the substrate relative to the ink output section; and a control section that controls the driving section. The control section causes the substrate to move relative to the ink output section such that the preheating target region is positioned in a progression path of the drawing target region and causes a pattern formed by the ink to be drawn, and when switching an extension direction of the pattern being drawn, the control section causes the preheating target region to move to an end portion of the pattern drawn before the switching and causing the preheating target region to be heated, and then causes the drawing target region to move to the end portion of the pattern drawn before the switching and causes a pattern to be drawn after the switching to begin being drawn. Also provided is a printing method.

According to a second aspect of the present invention, provided is a test apparatus that tests a device under test, comprising the pattern printing apparatus according to the first aspect that prints on the substrate a wiring pattern connecting to a terminal of the device under test; an implementing section that implements the device under test on the substrate having the wiring pattern printed thereon; a mounting section on which is mounted the substrate having the device under test implemented thereon; and a testing section that tests the device under test by exchanging electrical signals with the device under test via the substrate.

The summary clause does not necessarily describe all necessary features of the embodiments of the present invention. The present invention may also be a sub-combination of the features described above.

DESCRIPTION OF EXEMPLARY EMBODIMENTS

Hereinafter, some embodiments of the present invention will be described. The embodiments do not limit the invention according to the claims, and all the combinations of the features described in the embodiments are not necessarily essential to means provided by aspects of the invention.

Figure 1:
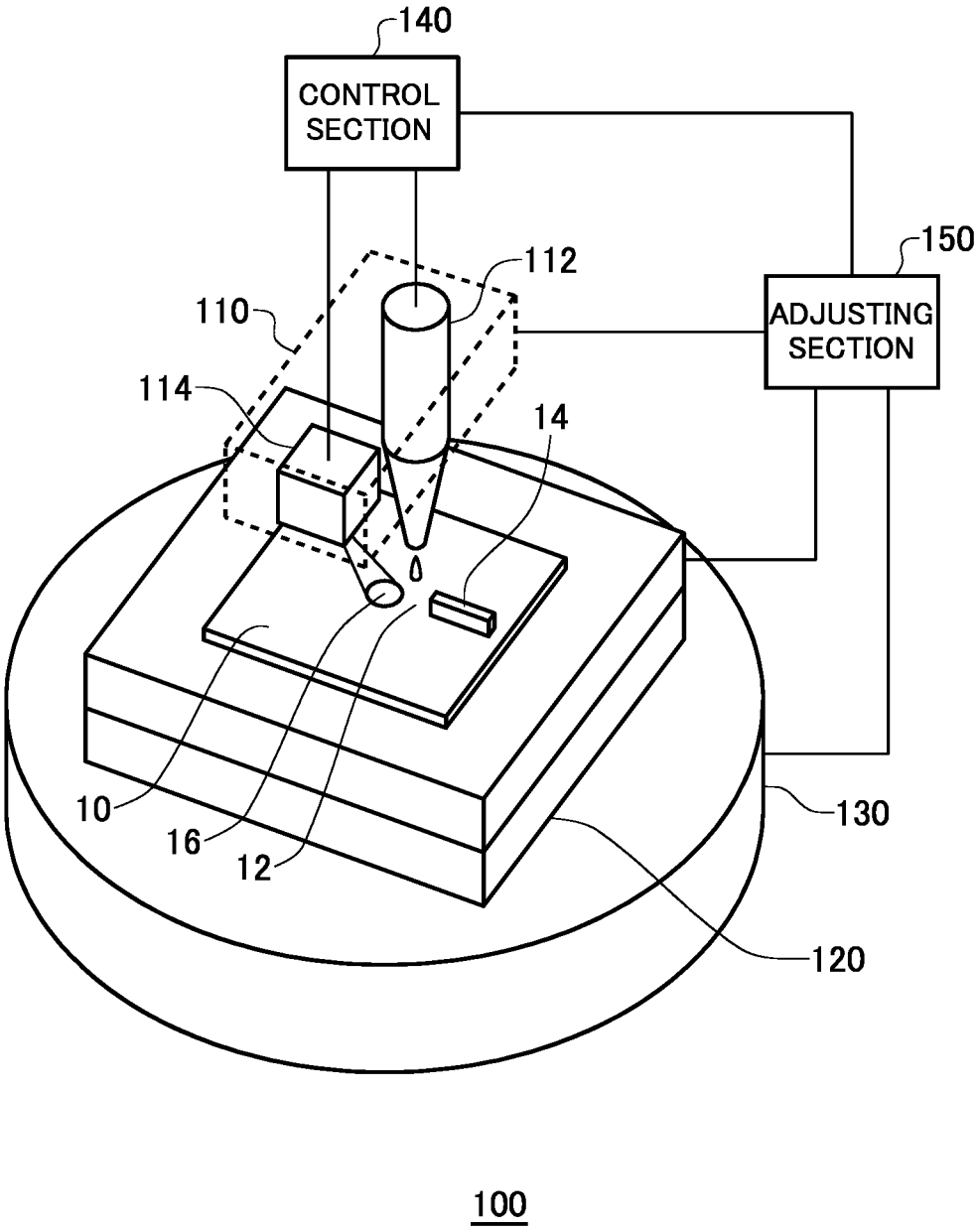
FIG. 1 shows an exemplary configuration of a pattern printing apparatus 100 according to an embodiment of the present invention, along with a substrate 10.

FIG. 1 shows an exemplary configuration of a pattern printing apparatus 100 according to an embodiment of the present invention, along with a substrate 10. When applying ink to a drawing target region on the substrate 10 and forming a pattern in the drawing target region, the pattern printing apparatus 100 forms the pattern after heating the next drawing target region. Furthermore, when changing the drawing direction in the pattern being drawn, the pattern printing apparatus 100 moves the substrate 10, heats the portion of the drawn pattern in which the pattern is to be formed next, and then forms the pattern in the altered drawing direction.

The substrate 10 is formed of an insulating material, and a wiring pattern 14 for transmitting electrical signals is formed on one surface of the substrate 10. One surface of the substrate 10 is flat. The substrate 10 may be a flexible substrate that can be deformed. The pattern printing apparatus 100 includes an ink output section 110, a driving section 120, a rotating section 130, a control section 140, and an adjusting section 150.

The ink output section 110 applies the ink while heating a portion of the substrate 10. The ink output section 110 includes a nozzle 112 and a heating section 114. The nozzle 112 applies ink drops to the drawing target region 12 of the substrate 10. The nozzle 112 may be an inkjet head portion that ejects ink from a thin tube as a result of deformation of a piezoelectric element through the application of voltage, for example. Instead, the nozzle 112 may be an inkjet head portion that ejects the ink from a thin tube as a result of air bubbles generated within the ink by using a heater or the like to heat the ink. As yet another example, the nozzle 112 may be a head that ejects ink toward a printing surface as a result of an electric field applied to a small drop of the ink through the application of ultrasonic waves or the like.

The nozzle 112 has an opening that is no greater than several hundred micrometers, and drops a drop of fluid having a diameter no greater than several hundred micrometers. The nozzle 112 preferably drops a drop of liquid having a diameter from 10 μm to 150 μm or lower. The nozzle 112 more preferably drops a drop of liquid having a diameter from 50 μm to 100 μm or lower.

In the present embodiment, the nozzle 112 drops ink that includes a conductive material. The ink may include fine particles with a particle diameter no greater than 1 μm formed of the conductive material. The conductive material may include one or more of the metals selected from the group including gold, silver, copper, platinum, palladium, tungsten, nickel, tantalum, bismuth, lead, indium, tin, zinc, titanium, and aluminum, or may include one or more oxides of these metals. The conductive material may include an alloy formed of two or more of these metals.

The drawing target region 12 is a region on one surface of the substrate 10 onto which the ink is dropped from the nozzle 112 to form the wiring pattern 14. The position of the drawing target region 12 may be determined according to information about the wiring pattern to be drawn in advance, or may be determined according to information about the wiring pattern to be drawn in advance, the amount of ink to be dropped, the speed at which the wiring pattern is to be formed, and the like.

FIG. 1 shows an example in which a portion of the wiring pattern 14 is formed on the substrate 10. In this case, the drawing target region 12 is set near an end surface of the formed wiring pattern 14. The drawing target region 12 is formed with a pattern according to the dropping of the ink, and the wiring pattern 14 extends to the drawing target region 12. After the wiring pattern 14 is extended, the drawing target region 12 is set near the end surface of the extended wiring pattern 14. In other words, the position of the drawing target region 12 on the substrate 10 is sequentially updated according to the form of the wiring pattern 14.

The heating section 114 heats a preheating target region 16 of the substrate 10 oriented in the direction in which the nozzle 112 proceeds relative to the substrate 10. The heating section 114 includes a light source section that radiates laser light toward one surface of the substrate 10, for example, and the preheating target region 16 is heated by absorbing this laser light. Instead, the heating section 114 may include a light source section such as an LED or lamp and an optical system such as a lens that focuses the light from the light source section, and the light from the light source may be focused on the preheating target region 16 to heat the preheating target region 16.

In order to drop the ink from the nozzle 112 with the drawing target region 12 heated to be within a predetermined temperature range by the heating section 114, the region to be the drawing target region 12 is heated as the preheating target region 16 during the step of forming the wiring pattern 14. In other words, the heating section 114 heats in advance a future drawing target region 12 that is farther in the progression direction of the nozzle 112 as the preheating target region 16, and this preheating target region 16 is then set as the drawing target region 12 by moving the nozzle 112 or the substrate 10. When the ink is then dropped from the nozzle 112, this region is already within the prescribed temperature range.

In the same manner as the drawing target region 12, the position of the preheating target region 16 may be determined according to information about the wiring pattern to be drawn in advance, or may be determined according to information about the wiring pattern to be drawn in advance, the amount of ink to be dropped, the speed at which the wiring pattern is to be formed, and the like.

The driving section 120 moves the substrate 10 relative to the ink output section 110. The driving section 120 may be a moving stage that has the substrate 10 fixed thereto and moves the substrate 10. Instead of this or in addition to this, the driving section 120 may be a moving stage that has the ink output section 110 fixed thereto and moves the ink output section 110 relative to the substrate 10. FIG. 1 shows an example in which the driving section 120 has the substrate 10 fixed thereto and moves the substrate 10.

The driving section 120 may have the other surface of the substrate 10 fixed thereto by attraction, or fixed thereto by being physically pressed from the one side of the substrate 10. The driving section 120 may be an XY stage that moves the substrate 10 within a plane perpendicular to the direction in which the ink from the nozzle 112 is dropped onto the substrate 10, for example.

The rotating section 130 rotates the substrate 10 relative to the ink output section 110. The rotating section 130 may be a rotating stage that has the substrate 10 fixed thereto and rotates the substrate 10 within a plane perpendicular to an axial direction, which is the direction in which the ink from the nozzle 112 is dropped onto the substrate 10. FIG. 1 shows an example in which an XY stage with the substrate 10 fixed thereto is mounted on the rotating section 130 and the rotating section 130 rotates the XY stage.

The control section 140 is connected to the driving section 120 and the rotating section 130, and controls the movement of the driving section 120 and the rotating section 130. The control section 140 controls the movement direction, movement distance, movement speed, and the like of the driving section 120, and also controls the rotation direction, rotation angle, rotation speed, and the like of the rotating section 130. The control section 140 is connected to the nozzle 112 and the heating section 114, and controls the dropping speed and amount of ink dropped from the nozzle 112, the heating temperature of the heating section 114, and the like.

The control section 140 moves the substrate 10 relative to the ink output section 110 such that the preheating target region 16 is positioned within the progression path of the drawing target region 12, and causes the pattern to be formed by the ink to be drawn on the drawing target region 12. In other words, the control section 140 controls the relative positions of the substrate 10 and the ink output section 110 such that the ink is dropped from the nozzle 112 onto the drawing target region 12 while the preheating target region 16 is heated by the heating section 114.

The control section 140 controls the movement speed of the driving section 120, the heating temperature of the heating section 114, the speed at which the ink is dropped from the nozzle 112, the amount of ink dropped from the nozzle 112, and the like, and therefore a predetermined amount of ink can be dropped while the drawing target region 12 is within a predetermined temperature range from 50° C. to 200° C., for example. In this way, by causing the ink from the nozzle 112 to be dropped while moving the substrate 10 relative to the ink output section 110, the control section 140 can increase the rate of evaporation of the dropped ink solution without causing boiling due to sudden heating and draw a pattern that includes lines with predetermined widths in the drawing target region 12.

The adjusting section 150 adjusts the drawing target region 12 to be positioned on the rotational axis of the rotating section 130. For example, the adjusting section 150 is connected to the control section 140, detects movement instructions or the like for the driving section 120 or the rotating section 130 from the control section 140, detects the relative positions of the substrate 10, the ink output section 110, and the driving section 120, and adjusts the position of the substrate 10 according to these relative positions. Instead, the adjusting section 150 may include a detection sensor that detects the position of the substrate 10, the ink output section 110, and/or the driving section 120 and may adjust the position of the substrate 10 according to the position detection results for the substrate 10, the ink output section 110, and the driving section 120.

When switching the direction in which the pattern being drawn extends, the pattern printing apparatus 100 according to the present embodiment moves the preheating target region 16 to be at the end portion of the pattern drawn before the switching, heats this preheating target region 16, and then moves the drawing target region 12 to the end portion of the pattern drawn before the switching and begins drawing the pattern to be drawn after the switching. This procedure of drawing a curved pattern by the pattern printing apparatus 100 is described below using FIGS. 2 to 6.

Figure 2:
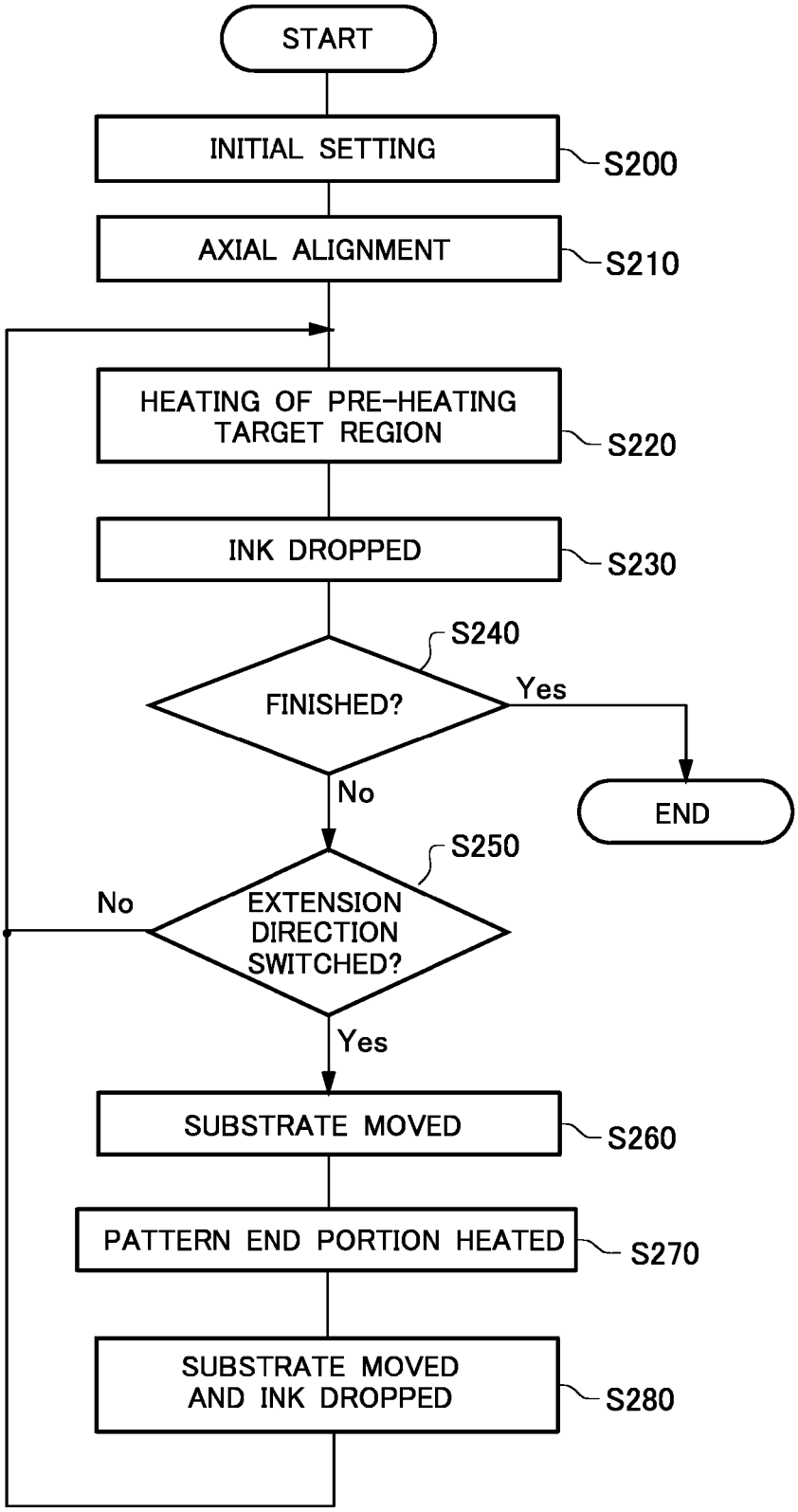
FIG. 2 shows the process flow of the pattern printing apparatus 100 according to the present embodiment.

FIG. 2 shows the process flow of the pattern printing apparatus 100 according to the present embodiment. FIGS. 3 to 6 show schematic configurations during the process of forming the wiring pattern 14 on one surface of the substrate 10 performed by the pattern printing apparatus 100 according to the present embodiment.

First, an initial setting is performed (S200). The pattern printing apparatus 100 may read the pattern information of the pattern to be drawn in advance. Instead, the pattern information for the pattern to be drawn may be designated by a user or the like. The pattern printing apparatus 100 mounts and fixes the substrate 10 on the driving section 120.

Next, axial alignment is performed (S210). For example, the control section 140 moves the driving section 120 and/or the ink output section 110 such that the position on the substrate 10 where the ink is dropped from the nozzle 112 is on the line extending along the rotational axis of the rotating section 130. The following describes an example in which, when the XY stage that moves the substrate 10 in the XY plane serves as the driving section 120, the direction in which the ink is dropped and the rotational axis of the rotating section 130 are both the Z direction, and the position where the ink is dropped is aligned on the rotational axis.

The control section 140 sets, as the preheating target region 16, a position on the substrate 10 at which the formation of the wiring pattern 14 is to begin, according to the pattern to be drawn. The control section 140 arranges the set preheating target region 16 such that the preheating target region 16 is located beyond the position on the substrate 10 where the nozzle 112 is to drop the ink, at a predetermined distance from the ink-dropping position in the direction in which the nozzle 112 progresses.

For example, when forming the wiring pattern 14 in the −X direction, the nozzle 112 progresses in the −X direction relative to the substrate 10, and therefore the preheating target region 16 is arranged at a position shifted by ΔX in the −X direction from the position where the nozzle 112 drops the ink. In this way, the set preheating target region 16 can be arranged on the substrate 10 such that, when the control section 140 moves the substrate 10 by ΔX in the X direction relative to the nozzle 112, the preheating target region 16 moves to the position of the drawing target region 12, which is the location where the nozzle 112 drops the ink.

Next, the heating section 114 heats the preheating target region 16 (S220). Specifically, the heating section 114 heats the region where the formation of the wiring pattern 14 is to begin.

Next, the control section 140 sets the heated preheating target region 16 to be the drawing target region 12. The control section 140 moves the set drawing target region 12 to be at the position where the nozzle 112 drops the ink. Here, the control section 140 may instruct the adjusting section 150 to move the drawing target region 12. The adjusting section 150 may control the driving section 120 to move the substrate 10 by ΔX in the X direction, for example, to arrange the drawing target region 12 at the position where the nozzle 112 drops the ink.

Next, the control section 140 causes the ink to be dropped onto the drawing target region 12 from the nozzle 112 (S230). In this way, the control section 140 can heat the drawing target region 12 to be within a prescribed temperature range and then drop the predetermined amount of ink onto the drawing target region 12. The solvent in the dropped ink evaporates, thereby forming a portion of the wiring pattern 14 on the drawing target region 12.

The control section 140 determines whether formation of the wiring pattern 14 is finished (S240) and whether the extension direction of the wiring pattern 14 being formed is to be switched (S250), based on the pattern to be drawn. If the control section 140 is to continue forming the wiring pattern 14 in a straight line without switching the extension direction of the wiring pattern 14, the process flow from step S220 to step S230 is repeated.

Figure 3:
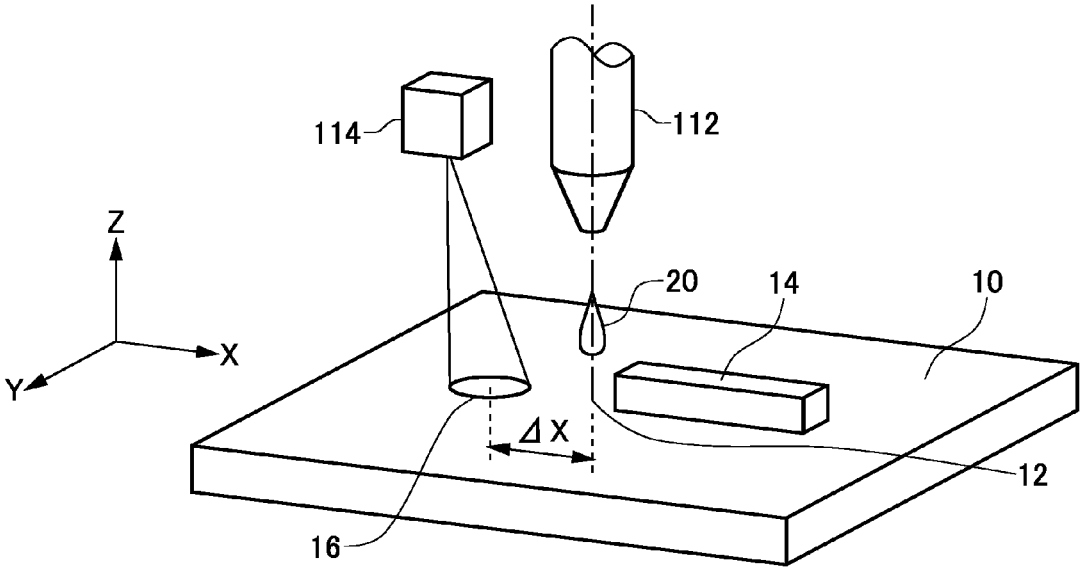
FIG. 3 shows an exemplary configuration at a stage where the pattern printing apparatus 100 according to the present embodiment has formed the wiring pattern 14 on the substrate 10.

In other words, the region near the end portion of the formed wiring pattern 14 is heated as the preheating target region 16, and this heated region is then moved to be the drawing target region 12 and the ink is dropped thereon. As a result of the solvent in the dropped ink evaporating, a pattern is formed at the end portion of the wiring pattern 14 that extends a predetermined wire length and has a predetermined thickness. This wire-length extension portion is repeated to form a wiring pattern 14 that extends as a straight line in the −X direction. FIG. 3 shows an exemplary configuration at a stage where the pattern printing apparatus 100 according to the present embodiment has formed the wiring pattern 14 on the substrate 10. Here, an example is shown in which the control section 140 has set the distance from the drawing target region 12 to the center of the preheating target region 16 to be ΔX.

When switching the extension direction of the pattern being drawn, the control section 140 moves the substrate 10 to have a predetermined angle relative to the ink output section 110 (S260). In this case, the rotating section 130 rotates to form a predetermined angle according to the pattern to be drawn, thereby changing the orientation of the substrate 10 relative to the ink output section 110. Since the drawing target region 12 is positioned on the rotational axis of the rotating section 130, the drawing target region 12 is still positioned on the rotational axis of the rotating section 130 after the rotation, and the position at which the nozzle 112 drops the ink 20 is still this drawing target region 12.

The control section 140 moves the preheating target region 16 to the end portion of the pattern drawn before the switching, heats this preheating target region 16, and then moves the drawing target region 12 to the end portion of the pattern drawn before the switching and begins drawing the pattern to be drawn after the switching. Specifically, the control section 140 controls the driving section 120 to move the substrate 10 relative to the nozzle 112 in the −Y direction by a predetermined amount and to move the preheating target region 16 to the end portion of the pattern drawn before the switching. For example, when the distance from the drawing target region 12 to the center of the preheating target region 16 is set to ΔX, the control section 140 can move the preheating target region 16 to the end portion of the pattern drawn before the switching by moving the preheating target region 16 by ΔX in the −Y direction.

Figure 4:
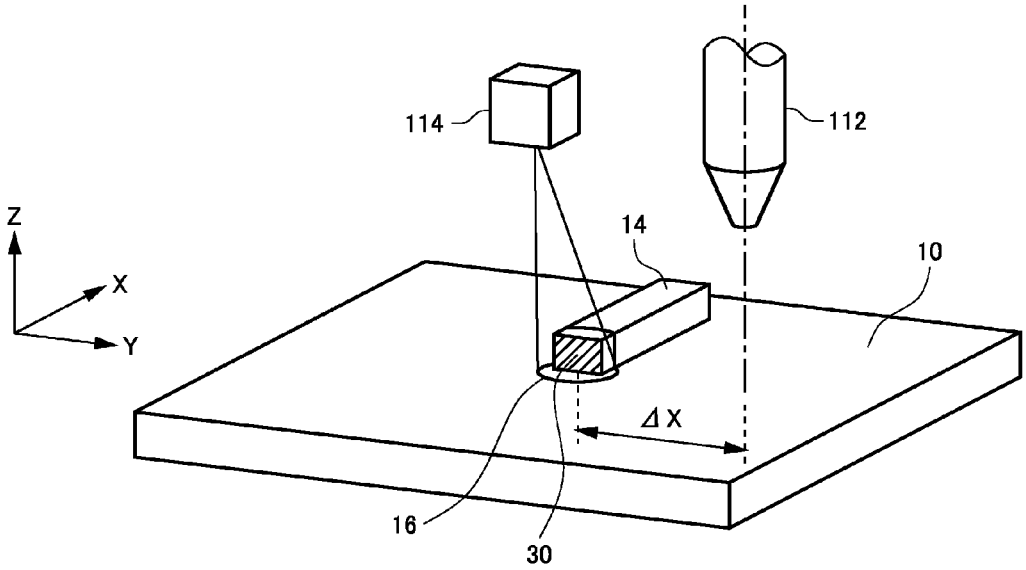
FIG. 4 shows an exemplary configuration at a stage where the pattern printing apparatus 100 according to the present embodiment heats the end portion of the wiring pattern 14 after moving the substrate 10.

Next, the control section 140 heats the end portion of the pattern positioned in the preheating target region 16 (S270). FIG. 4 shows an exemplary configuration at a stage where the pattern printing apparatus 100 according to the present embodiment heats the end portion 30 of the wiring pattern 14 after moving the substrate 10. Here, an example is shown in which the control section 140 switches the extension direction of a wiring pattern 14 extending in the −X direction by 90°, thereby causing the wiring pattern 14 to extend in the −Y direction.

Next, the adjusting section 150 controls the driving section 120 to move the substrate 10 relative to the nozzle 112 by a predetermined distance in the Y direction and moves the drawing target region 12 to the end portion of the pattern drawn before switching, and the control section 140 drops the ink 20 from the nozzle 112 (S280). In this way, the control section 140 can drop the ink after setting the end portion of the pattern to be drawn after switching and the nearby region to be within a predetermined temperature range, and can therefore begin drawing the pattern to be drawn after switching from the end portion of the pattern drawn before switching.

Figure 5:
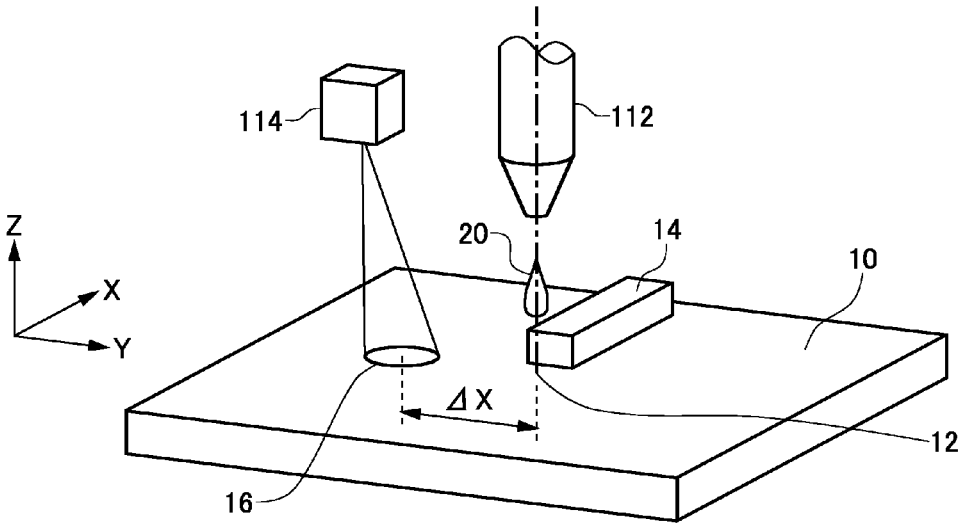
FIG. 5 shows an exemplary configuration at a stage where the pattern printing apparatus 100 according to the present embodiment moves the drawing target region to the end portion of the wiring pattern 14 and begins drawing the pattern.

FIG. 5 shows an exemplary configuration at a stage where the pattern printing apparatus 100 according to the present embodiment moves the drawing target region 12 to the end portion of the wiring pattern 14 and begins drawing the pattern. Here, the wiring pattern 14 extends in the −Y direction, and the preheating target region 16 is positioned at a distance ΔX in the −Y direction from the drawing target region 12, which is the position where the ink 20 is dropped.

Figure 6:
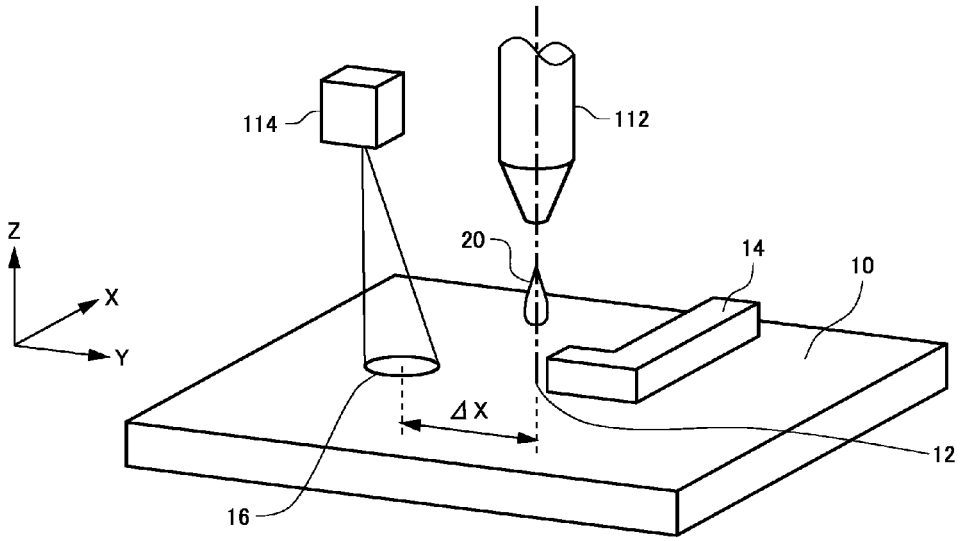
FIG. 6 shows an exemplary configuration at a stage where the pattern printing apparatus 100 according to the present embodiment has switched the extension direction of the wiring pattern 14 and then formed another wiring pattern 14.

The process then returns to step S220 and the steps of heating the preheating target region 16, dropping the ink 20, and moving the substrate 10 are repeated, thereby enabling the wiring pattern 14 to extend in the −Y direction. FIG. 6 shows an exemplary configuration at a stage where the pattern printing apparatus 100 according to the present embodiment has switched the extension direction of the wiring pattern 14 and then formed another wiring pattern 14.

By performing the above process flow, the pattern printing apparatus 100 can draw a pattern including lines that bend at predetermined angles on the substrate 10. When changing the extension direction of the pattern being drawn by a predetermined angle or greater, the pattern printing apparatus 100 draws the pattern by performing the above process flow. On the other hand, when changing the extension direction of the pattern being drawn by less than this predetermined angle, the pattern printing apparatus 100 switches the extension direction and then continues drawing the pattern.

If the bending angle of the pattern being drawn is small, there is almost no difference between the shape of the pattern before switching and the shape of the pattern after switching, and therefore even if the pattern printing apparatus 100 were to switch the extension direction and then directly continue drawing the wire line, the wiring pattern can be formed without negatively affecting the shape. Accordingly, by measuring in advance the angles caused by switching the extension directions that still enable the wiring pattern to be formed without any negative effect on the shape and storing this angle information, the pattern printing apparatus 100 can selectively perform the procedure appropriate for the switching angle.

The pattern printing apparatus 100 according to the present embodiment described above is an example in which the wiring pattern is formed by dropping ink including a conductive material onto a substrate 10. Instead, the nozzle 112 may drop ink forming a resist on the drawing target region 12 of the substrate 10, and the control section 140 may draw a predetermined resist pattern on the substrate 10. In this case, the pattern printing apparatus serves as a resist pattern printing apparatus.

Figure 7:
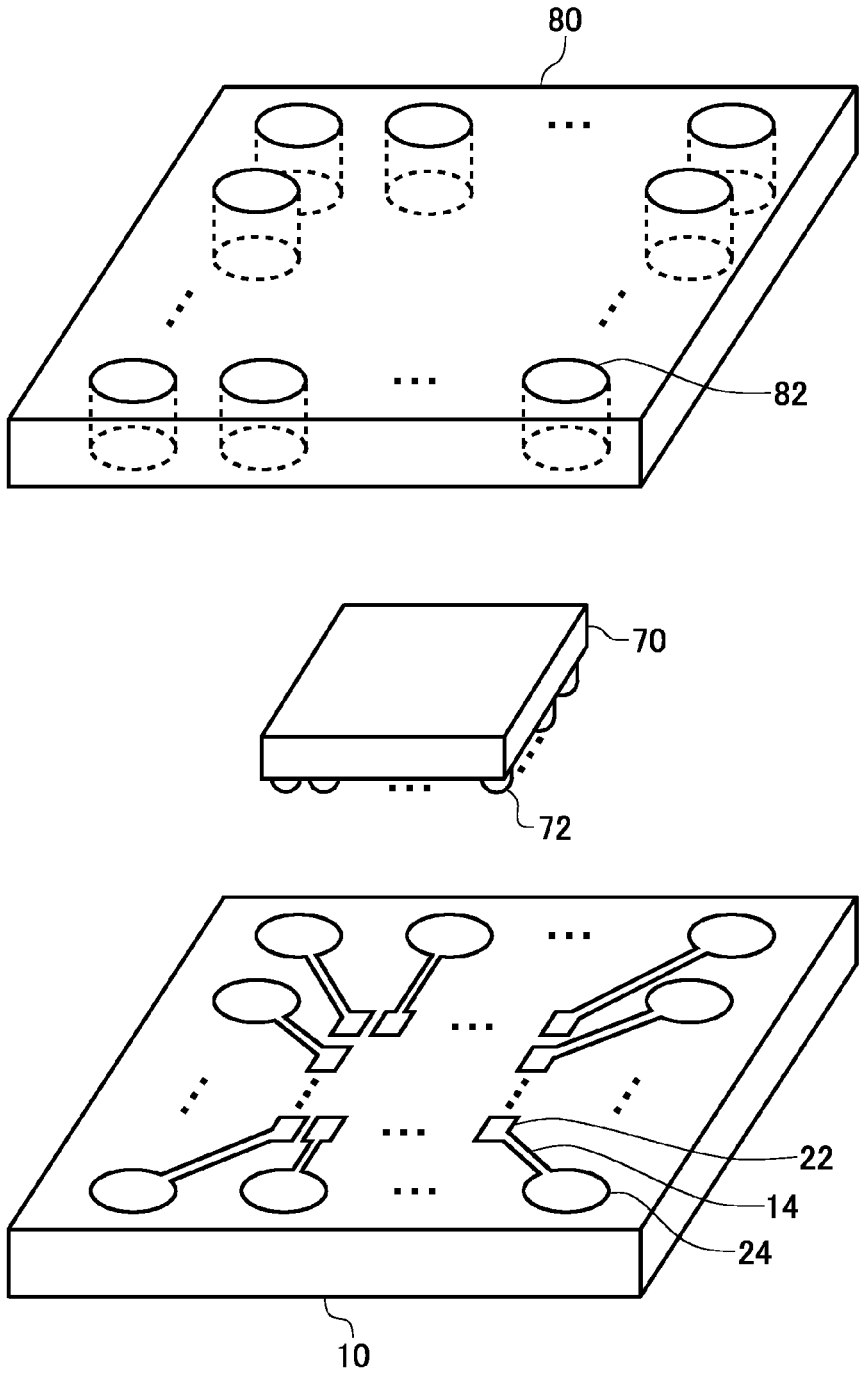
FIG. 7 shows an exemplary configuration of a test package of a device under test 70, using a substrate 10 having a wiring pattern 14 formed by the pattern printing apparatus 100 according to the present embodiment.

FIG. 7 shows an exemplary configuration of a test package of a device under test 70, using a substrate 10 having a wiring pattern 14 formed by the pattern printing apparatus 100 according to the present embodiment. The test package is used to package the device under test 70. The test package may be mounted in a test apparatus, for example. This test apparatus tests the device under test 70 by electrically connecting to the device under test 70 within the test package.

The device under test 70 may be a semiconductor device or a semiconductor chip on which is formed an analog circuit, a digital circuit, a memory, and/or a system on chip (SOC), for example. The device under test 70 includes a plurality of terminals 72 that receive electrical signals. The terminals 72 operate as input terminals and/or output terminals. The terminals 72 may be exposed conductive material such as electrical wires, solder bumps, or lands formed on one surface of the device under test 70, for example.

The test package includes the substrate 10 and a flexible substrate 80, and the device under test 70 is mounted by being sandwiched between the substrate 10 and the flexible substrate 80. The substrate 10 has a wiring pattern 14 formed thereon by the pattern printing apparatus 100, and the wiring pattern 14 includes a device connecting section 22 and a substrate connecting section 24. The substrate 10 preferably includes a number of device connecting sections 22 and substrate connecting sections 24 at least equal to the number of terminals 72 in the device under test 70.

Each device connecting section 22 is connected to a terminal 72 of the device under test 70 and exchanges electric signals with this terminal 72. When the device under test 70 is mounted on the substrate 10, each device connecting section 22 is in contact with and electrically connected to the corresponding terminal 72.

The substrate connecting sections 24 are formed to correspond respectively to the device connecting sections 22, and are electrically connected to the corresponding device connecting sections 22 through the wiring pattern 14. The substrate connecting sections 24 are preferably formed closer to the border of the substrate 10 than the device connecting sections 22, and preferably have a greater pitch and greater surface area than the device connecting sections 22.

The flexible substrate 80 is elastic and can deform. The flexible substrate 80 includes a plurality of external connecting sections 82. The external connecting sections 82 are formed to correspond to the substrate connecting sections 24 of the flexible substrate 80. The external connecting sections 82 each include terminals formed by exposed conductive material on both surfaces of the flexible substrate 80, and the terminals on the one surface are electrically connected to the terminals on the other surface. For example, one surface of the flexible substrate 80 covers the other surface of the device under test 70, and the terminals formed on the one surface of the flexible substrate 80 are electrically connected to the corresponding substrate connecting section 24.

The device under test 70 is sandwiched between the substrate 10 and the flexible substrate 80, thereby forming the test package. The test package may be a sealed package formed by expelling the atmosphere from between the substrate 10 and the flexible substrate 80. Instead, the test package may be a package in which the device under test 70 is sandwiched and fixed by pressing the flexible substrate 80 against the substrate 10.

With the device under test 70 in the fixed state, the terminals 72 of the device under test 70 are each electrically connected to the corresponding external connecting section 82 of the flexible substrate 80, via the corresponding device connecting section 22 and substrate connecting section 24. In this way, by electrically connecting the test apparatus to the terminals of the external connecting section 82 formed on the other surface of the flexible substrate 80, electrical signals can be exchanged with the corresponding terminals 72 of the device under test 70 fixed within the test package.

This type of test package connects the small terminals 72 formed on the device under test 70 with a narrow pitch to the corresponding wiring pattern 14 formed on the substrate 10, and therefore a pitch that is wider than that of the terminals 72 can be realized. Furthermore, the test package sandwiches a semiconductor chip cut from a semiconductor wafer on which electronic circuits are formed, and therefore the test package can be mounted on a test apparatus or the like The substrate 10 and/or the flexible substrate 80 forming the test package can have the wiring pattern formed thereon by the pattern printing apparatus 100 according to the present embodiment, and therefore the wires with a complex bending pattern can be formed with a wire pitch and wire width no greater than tens of micrometers. Furthermore, since the pattern printing apparatus 100 uses an inkjet system, the pattern printing apparatus 100 is small and lightweight, and can easily form a fine pattern.

Figure 8:
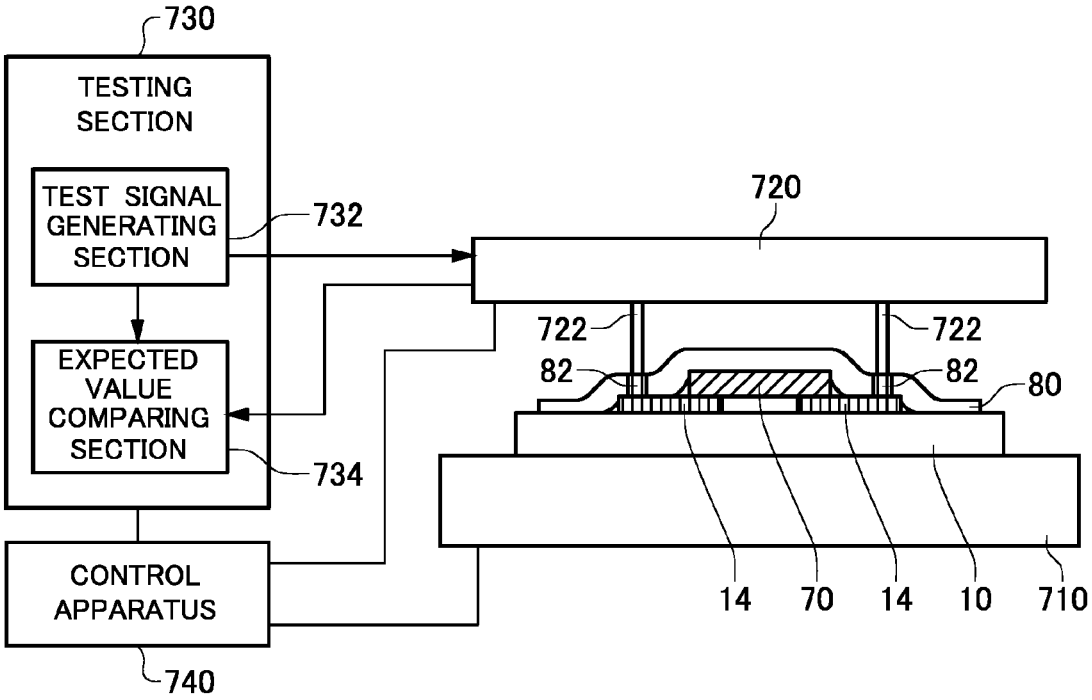
FIG. 8 shows an exemplary configuration of a test apparatus 700 according to the present embodiment, along with a device under test 70.

FIG. 8 shows an exemplary configuration of a test apparatus 700 according to the present embodiment, along with a device under test 70. The test apparatus 700 has one or more of the test packages described in the above embodiment mounted thereon, and tests the device under test 70 in the test packet. The test apparatus 700 inputs to the device under test 70 a test signal based on a test pattern for testing the device under test 70, and judges pass/fail of the device under test 70 based on an output signal that is output by the device under test 70 in response to the test signal.

The test apparatus 700 includes a mounting section 710, a test head section 720, a testing section 730, and a control apparatus 740. The mounting section 710 has one or more test packages mounted thereon. A substrate 10 with the device under test 70 implement thereon may be mounted on the mounting section 710. In this case, the test apparatus 700 exchanges electrical signals by electrically contacting the substrate connecting section 24 formed on the substrate 10.

The test head section 720 includes a plurality of probe sections 722, and is electrically connected to the test package via the probe sections 722. The probe sections 722 are formed on the test head section 720 to correspond to the terminals 72 of the device under test 70, and are electrically connected to corresponding external connecting sections 82 of the test package to exchange electrical signals with the corresponding terminals 72.

The testing section 730 tests the device under test 70 by exchanging electrical signals with the device under test 70. The testing section 730 includes a test signal generating section 732 and an expected value comparing section 734.

The test signal generating section 732 is connected to one or more devices under test 70 via the test head section 720, and generates a plurality of test signals to be supplied to the device under test 70. The test signal generating section 732 may generate an expected value for a response signal to be output by the device under test 70 in response to the test signal.

The expected value comparing section 734 compares the data value included in the response signal of the device under test 70 received from the test head section 720 to the expected value generated by the test signal generating section 732. The expected value comparing section 734 judges pass/fail of the device under test 70 based on the comparison results.

The control apparatus 740 controls the mounting of the test package on the mounting section 710, the electrical connection of the external connecting section 82 of the test package to the probe section 722 of the test head section 720, and the starting, ending, stopping, and pausing of the testing of the testing section 730, according to a test program, in order to cause the test apparatus to perform testing. The test apparatus 700 according to the present embodiment described above can have a test package mounted thereon and test the device under test 70 within the test package.

The test apparatus 700 may further include a pattern printing apparatus 100 that prints on the substrate 10 a wiring pattern 14 connecting to the terminals of the device under test 70, an implementing section that implements the device under test 70 on the substrate 10 having the wiring pattern 14 printed thereon, a package portion that attaches the flexible substrate 80 to the substrate 10 to form a package, and a handler section in which the test package is mounted on the mounting section 710. In this way, the test apparatus 700 can form a test package for a device under test 70 and can test this test package.

While the embodiments of the present invention have been described, the technical scope of the invention is not limited to the above described embodiments. It is apparent to persons skilled in the art that various alterations and improvements can be added to the above-described embodiments. It is also apparent from the scope of the claims that the embodiments added with such alterations or improvements can be included in the technical scope of the invention.

The operations, procedures, steps, and stages of each process performed by an apparatus, system, program, and method shown in the claims, embodiments, or diagrams can be performed in any order as long as the order is not indicated by "prior to," "before," or the like and as long as the output from a previous process is not used in a later process. Even if the process flow is described using phrases such as "first" or "next" in the claims, embodiments, or diagrams, it does not necessarily mean that the process must be performed in this order.

What is claimed is:

1. A pattern printing apparatus comprising:

an ink output section including a nozzle that drops ink onto a drawing target region of a substrate and a heating section that heats a preheating target region of the substrate positioned at a predetermined distance from the drawing target region;

a driving section that moves the substrate relative to the ink output section; and a control section that controls the driving section;

wherein, when drawing a straight line of a pattern formed by the ink, the control section causes the substrate to move relative to the ink output section such that the preheating target region is positioned in a progression path of the drawing target region, and causes the pattern to be drawn;

wherein, when switching an extension direction of the pattern being drawn by less than a predetermined angle, the control section causes the substrate to rotate according to the extension direction, and causes the pattern to be drawn; and wherein, when switching the extension direction of the pattern being drawn by greater than or equal to the predetermined angle, the control section causes the substrate to rotate according to the extension direction, causes the preheating target region to backtrack to an end portion of an already drawn portion of the pattern, causes the preheating target region to be heated, causes the drawing target region to move to the end portion of the already drawn portion of the pattern, and causes a remaining portion of the pattern to be drawn.

2. The pattern printing apparatus according to claim 1, further comprising:

a rotating section that rotates the substrate relative to the ink output section; and an adjusting section that adjusts the drawing target region to be positioned on a rotational axis of the rotating section.

3. The pattern printing apparatus according to claim 1, wherein the control section causes the ink to be dropped from the nozzle while causing the substrate to move relative to the ink output section, thereby causing a pattern including a line with a predetermined width to be drawn.

4. The pattern printing apparatus according to claim 1, wherein the heating section includes a light source section that radiates laser light to the substrate.

5. The pattern printing apparatus according to claim 1, wherein the nozzle drops ink that includes electrically conductive material.

6. The pattern printing apparatus according to claim 1, wherein the pattern printing apparatus is a resist pattern printing apparatus, the nozzle drops ink forming a resist on the drawing target region of the substrate, and the control section causes a predetermined resist pattern to be drawn on the substrate.

7. A pattern printing method comprising:

dropping ink from a nozzle onto a drawing target region of a substrate;

heating a preheating target region of the substrate positioned at a predetermined distance from the drawing target region; and moving the substrate relative to the nozzle; and drawing a pattern formed by the ink;

wherein, when drawing a straight line of the pattern, the substrate is moved such that the preheating target region is positioned in a progression path of the drawing target region;

wherein, when switching an extension direction of the pattern by less than a predetermined angle, the substrate is rotated according to the extension direction and then moved in the progression path; and wherein, when switching the extension direction of the pattern by greater than or equal to the predetermined angle, the substrate is rotated according to the extension direction, the preheating target region is backtracked to an end portion of an already drawn portion of the pattern and heated, the preheating target region is heated, the drawing target region is moved to the end portion of the already drawn portion of the pattern, and a remaining portion of the pattern is drawn.

8. A test apparatus that tests a device under test, comprising:

the pattern printing apparatus according to claim 1 that prints on the substrate a wiring pattern connecting to a terminal of the device under test;

an implementing section that implements the device under test on the substrate having the wiring pattern printed thereon;

a mounting section on which is mounted the substrate having the device under test implemented thereon; and a testing section that tests the device under test by exchanging electrical signals with the device under test via the substrate.

* * * * *